US008559043B2

(12) United States Patent
Kobayashi et al.

(10) Patent No.: US 8,559,043 B2
(45) Date of Patent: Oct. 15, 2013

(54) PAPER OUTPUT DEVICE AND IMAGE FORMING APPARATUS

(75) Inventors: Yoshiyuki Kobayashi, Osaka (JP); Masaharu Kimura, Nara (JP); Yasuaki Fukada, Nara (JP); Masahiko Fujita, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 172 days.

(21) Appl. No.: 13/318,832

(22) PCT Filed: Apr. 9, 2010

(86) PCT No.: PCT/JP2010/056428
§ 371 (c)(1),
(2), (4) Date: Nov. 4, 2011

(87) PCT Pub. No.: WO2010/137410
PCT Pub. Date: Dec. 2, 2010

(65) Prior Publication Data

US 2012/0050809 A1 Mar. 1, 2012

(30) Foreign Application Priority Data

May 27, 2009 (JP) ..... 2009-128013

(51) Int. Cl.
*G06F 3/12* (2006.01)

(52) U.S. Cl.
USPC ..... 358/1.15; 271/291; 271/278; 271/281; 399/405; 399/406; 399/407; 358/501; 358/502; 358/503

(58) Field of Classification Search
None
See application file for complete search history.

(56) References Cited

U.S. PATENT DOCUMENTS

| | | | | |
|---|---|---|---|---|
| 5,497,984 | A * | 3/1996 | Murakami et al. | 270/58.02 |
| 2004/0140608 | A1* | 7/2004 | Mui et al. | 271/207 |
| 2004/0140611 | A1* | 7/2004 | Mui et al. | 271/279 |
| 2004/0232610 | A1* | 11/2004 | Saito et al. | 270/58.09 |
| 2004/0251608 | A1* | 12/2004 | Saito et al. | 271/220 |
| 2006/0071413 | A1* | 4/2006 | Kaneko et al. | 271/220 |
| 2006/0202402 | A1* | 9/2006 | Nagata et al. | 270/58.08 |

FOREIGN PATENT DOCUMENTS

| | | |
|---|---|---|
| JP | 62-089252 | 6/1987 |
| JP | 09-240901 | 9/1997 |
| JP | 2002-370861 | 12/2002 |
| JP | 2004-115236 | 4/2004 |
| JP | 2005-096964 | 4/2005 |
| JP | 2005-263355 | 9/2005 |
| JP | 2007-062928 | 3/2007 |

OTHER PUBLICATIONS

International Search Report for corresponding International Application No. PCT/JP2010/056428 mailed May 18, 2010.

* cited by examiner

*Primary Examiner* — Hilina K Demeter
(74) *Attorney, Agent, or Firm* — Renner, Otto, Boisselle & Sklar, LLP

(57) ABSTRACT

An image forming apparatus (50) at least includes a paper output tray (80), an actuator (16) and a photo sensor (15). The actuator (16) is supported in such a manner as to be swingable above a paper loading surface of the paper output tray (80). The actuator (16) includes a fullness detection section (164) and a rear edge curling detection section (162). The fullness detection section (164) is disposed at a tip portion of the actuator (16), being configured so as to contact the uppermost paper on the paper output tray (80). The rear edge curling detection section (162) is formed so as to extend from the fullness detection section (164) toward a direction that gets further away from the paper loading surface of the paper output tray (80) toward a direction generally parallel to the paper loading surface of the paper output tray (80) and opposite to a paper conveying direction.

10 Claims, 7 Drawing Sheets

PAPER OUTPUT DEVICE AND IMAGE FORMING APPARATUS

TECHNICAL FIELD

The present invention relates to a paper output device provided with a fullness detection sensor that detects fullness of sheets of paper having been outputted onto a paper output tray, and to an image forming apparatus provided with the same.

BACKGROUND ART

Generally, an image forming apparatus such as copier, facsimile or printer is equipped with a paper output device for discharging and conveying a sheet of paper that has undergone an image forming process onto a paper output tray. And, in many cases, such a paper output device is provided with a fullness detection sensor to detect fullness of sheets of paper on the paper output tray. It has been considered that, because the fullness of the paper on the paper output tray is detected using the fullness detection sensor, such a malfunction as the paper keeps being successively outputted while the paper output tray is in fullness can be prevented from occurring, and thus that the malfunction related to output of the paper by the paper output device can be prevented from occurring.

However, the paper on the paper output tray is not always kept flat, but sometimes can be curved upward at its both edges in paper width direction perpendicular to a paper conveying direction, or at its rear edge. For example, the paper such as recording paper having been sent out of a fuser unit can be left with a state of curling in which both edge portions of the paper in the paper width direction are curved upward due to an effect of heating at the time of fusing.

Thus, among conventional image forming apparatus is there one that is configured so as to have, both in the middle and in the neighborhoods of the edge portions in the paper width direction, a plurality of fullness detection means each to detect an occurrence of the fullness of the paper having been outputted on the paper output tray (for example, refer to Patent Literature 1). In the technique, a method of detection is employed in which a position of an actuator for fullness detection and a position of another actuator for curling detection are detected by a single photo sensor.

CITATION LIST

Patent Literature

Patent Literature 1: Japanese Patent Unexamined Publication No. 2007-62928 bulletin

SUMMARY OF INVENTION

Technical Problem

In the technique according to the Patent Literature 1 above, because it is necessary to install an actuator for fullness detection and an actuator for curling detection separately, and because it is necessary to install a mechanism to cause the photo sensor to work in connection with the actuators for both the fullness detection and the curling detection, there has been a problem that the number of necessary parts increases, which leads to an increased cost.

Further, when the number of actuators is increased, it has sometimes been experienced that output of a sheet of paper is not carried out adequately due to friction between the sheet of paper and the actuators; and moreover, there has been a risk that the sheet of paper being outputted is outputted obliquely onto the paper output tray because of the sheet of paper's being brought into contact with the actuators that are placed at positions other than the middle in the paper width direction, and hence that stack quality of the sheets of paper on the paper output tray deteriorates (becomes untidy).

The present invention is directed to providing a paper output device and an image forming apparatus each capable of detecting a state of fullness and a state of curling of the paper in a simple configuration, without using an actuator to detect solely the occurrence of the state of curling of the paper separately.

Solution to Problem

A paper output device according to the present invention comprises at least a paper output tray, an actuator and a fullness determination section. The paper output tray is configured in such a manner that a sheet of paper having undergone a predetermined process is outputted thereon. The actuator is supported in such a manner as to be swingable above a paper loading surface of the paper output tray. The actuator is configured in such a manner as to be displaced upward by a force acting thereon from an uppermost sheet of paper as a position of the uppermost sheet of paper on the paper output tray rises. The fullness determination section determines that sheets of paper on the paper loading surface of the paper output tray have reached a state of fullness at the time when it detects that the actuator has been displaced to a predetermined height by the uppermost sheet of paper on the paper output tray.

Further, the above mentioned actuator includes a fullness detection section and a rear edge curling detection section. The fullness detection section is disposed at a tip portion of the actuator, and is configured so as to be in contact with the uppermost sheet of paper on the paper output tray. The rear edge curling detection section is formed so as to extend from the fullness detection section toward a direction that gets further away from the paper loading surface of the paper output tray when viewed toward a direction that is generally parallel to the paper loading surface of the paper output tray and is opposite to a paper conveying direction (upstream side of the paper conveying path).

In this configuration, the paper in a flat state without curling lifts the actuator through its contact with the fullness detection section, whereas the paper in a state with curling at the rear edge thereof lifts the actuator through its contact with the rear edge curling detection section. So, this configuration enables a single actuator to detect both the state of fullness and the state of rear edge curling of the paper on the paper output tray. As a result, it becomes unnecessary to install an actuator to detect the state of rear edge curling of the paper on the paper output tray separately, which makes it possible to simplify and miniaturize an apparatus, and thus to reduce the cost thereof.

Further, because the paper with curled rear edge allows the actuator to detect the fullness with a less number of sheets of paper outputted as compared with the fullness in normal state, such a malfunction as the curled rear edge on the paper output tray is jammed between the rollers disposed at a paper output port becomes less likely to occur.

Advantageous Effects of Invention

With the present invention, detecting a state of fullness and a state of curling of the paper using a simple configuration is achievable without using an actuator to detect solely the occurrence of the state of curling of the paper separately.

DESCRIPTION OF EMBODIMENTS

Figure 1:
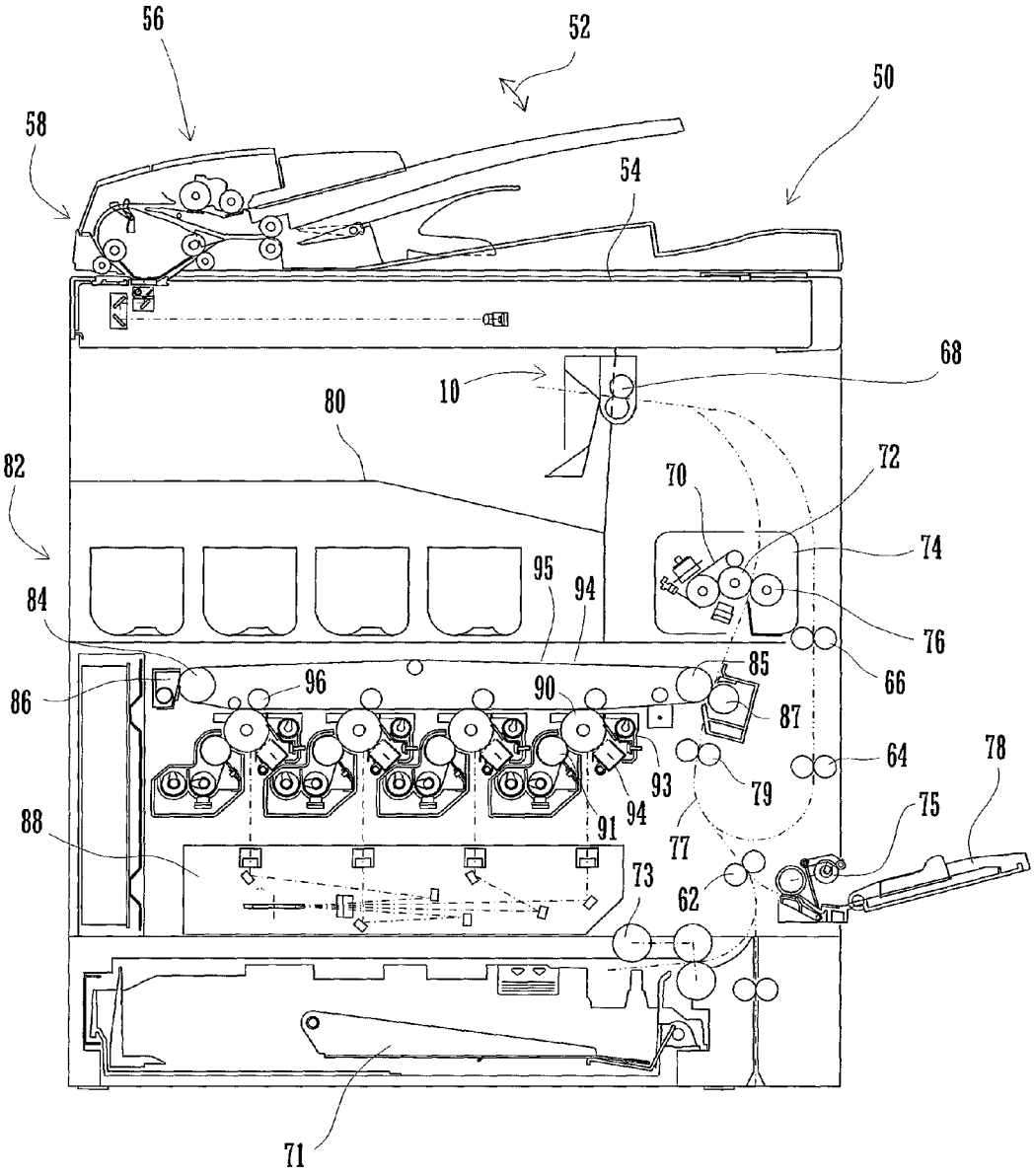
FIG. 1 is a drawing showing a configurative outline of an image forming apparatus according to an embodiment of the present invention.

FIG. 1 is a drawing showing a configurative outline of an image forming apparatus 50 according to an embodiment of the present invention. The image forming apparatus 50 is one that forms a multicolored or monochromatic image onto a predetermined paper sheet (recording medium) depending on image data that have been transmitted from outside, and includes an image forming section 82 and a document reading section 58.

The image forming section 82 is configured including an optical scanner 88, a developing device 91, a photoreceptor drum 90, a cleaner unit 93, an electrostatic charger 92, an intermediate transfer belt unit 95, a fuser unit 74, a paper feed cassette 71, a paper output tray 80 and so forth.

On an upside of the image forming section 82 is provided a document loading table 54 made of a transparent glass on which a document is placed, and above the document loading table 54 is installed an automatic document processing unit 56. The automatic document processing unit 56 automatically conveys the document onto the document loading table 54. Also, the automatic document processing unit 56 is configured in such a manner as to be swung freely, thereby allowing a user to place the document manually on the document loading table 54 when upside thereof is opened.

The image data handled in the image forming apparatus correspond to a color image formed making use of respective colors of black (k), cyan (C), magenta (M) and yellow (Y). Accordingly, the developing device 91, the photoreceptor drum 90, the electrostatic charger 92 and the cleaner unit 93 are respectively installed by tetrad so as to form four kinds of latent images corresponding to the respective colors, and are respectively set to black, cyan, magenta and yellow; whereby four image forming stations are configured.

The electrostatic charger 92 is a charging means to charge a surface of the photoreceptor drum 90 uniformly at a predetermined electrostatic potential; and other than a charger type as shown in FIG. 1, a contact type electrostatic charger such as roller type or brush type is occasionally used.

The optical scanner 88 is configured so as to form an electrostatic latent image on the respective surfaces of the photoreceptor drums 90 based on the image data inputted. Detailed description of the optical scanner 88 will be given later.

Each of the developing devices 91 is one that makes an electrostatic latent image formed on the corresponding each of the photoreceptor drums 90 a manifest image with corresponding each of toners for the four colors (YMCK). And then, the cleaner unit 93 removes and collects the toner which remains on the surface of the photoreceptor drum 90 after an image transfer has been carried out.

The intermediate transfer belt unit 95 disposed above the photoreceptor drums 90 includes an intermediate transfer belt 94, an intermediate transfer belt drive roller 85, an intermediate transfer belt idle roller 84, an intermediate transfer rollers 96 and an intermediate transfer belt cleaning unit 86. As regards the intermediate transfer roller 96 above, four of them are installed corresponding to the respective colors in use for the YMCK.

The intermediate transfer belt drive roller 85, the intermediate transfer belt idle roller 84 and the intermediate transfer rollers 96 pass and rotate the intermediate transfer belt 94 over them in a tensioned condition. Also, each intermediate transfer roller 96 gives a transfer bias to cause the toner image on each photoreceptor drum 90 to be transferred onto the intermediate transfer belt 94.

The intermediate transfer belt 94 is installed in such a manner as to be in contact with each of the photoreceptor drums 90, and performs a function to form a color toner image (multicolored toner image) on the intermediate transfer belt 94 through sequential superimposition of transfer of the toner images of respective colors formed on the photoreceptor drums 90 onto the intermediate transfer belt 94. The intermediate transfer belt 94 is formed into an endless shape, for example, with a film of around 100 μm through 150 μm thick.

The transfer of the toner images from the photoreceptor drums 90 onto the intermediate transfer belt 94 is carried out by the intermediate transfer rollers 96 each in contact with a backside of the intermediate transfer belt 94. To the intermediate transfer roller 96, a high-voltage transfer bias (a high voltage of reverse polarity (+) to the electrostatic charge polarity (−) of the toner) is applied in order to transfer the toner image. The intermediate transfer roller 96 is a roller that is formed with a shaft made of metal (e.g., stainless steel) having a diameter of 8 through 10 mm as a base material with the surface thereof covered with an electrically-conductive elastomer (e.g., EPDM, urethane foam or the like). The electrically-conductive elastomer makes it possible to apply a high voltage uniformly to the intermediate transfer belt 94. Although roller geometry is used as a transfer electrode in this embodiment, a brush-shaped transfer electrode or the like may be used otherwise.

The electrostatic latent images that have been made a manifest image on the respective photoreceptor drums 90 depending on the respective hues as described above are superimposed on the intermediate transfer belt 94. The image information that has been superimposed in this manner is transferred onto a paper sheet by a transfer roller 87 below that is disposed at a position where the paper sheet is brought into contact with the intermediate transfer belt 94 as the intermediate transfer belt 94 rotates.

At this time, the intermediate transfer belt 94 and the transfer roller 87 are caused to press and contact each other with a predetermined nip pressure, and a voltage (a high voltage of reverse polarity (+) to the electrostatic charge polarity (−) of the toner) to cause the toner image to be transferred onto the paper sheet is applied to the transfer roller 87. Further, in order to constantly maintain the above described nip pressure, either the transfer roller 87 or the intermediate transfer belt drive roller 85 is chosen to be made of a rigid material (metal, etc.); and then to the other, a flexible material such as an elastic roller (elastic rubber roller or foamed resin roller, etc.) is employed.

Also, the intermediate transfer belt cleaning unit 86 is set up so as to remove and collect the toner which adhered to the intermediate transfer belt 94 through its contact with the photoreceptor drum 90 as described above or which is untransferred onto the paper sheet by the transfer roller 87 and remains on the intermediate transfer belt 94; because, otherwise such toner would cause color mixture of toners to occur in the next step. The intermediate transfer belt cleaning unit 86 is equipped with, for instance, a cleaning blade as a cleaning member that is in contact with the intermediate transfer belt 94, and the intermediate transfer belt 94 with which the cleaning blade is in contact is supported from its backside by the intermediate transfer belt idle roller 84.

The paper feed cassette 71 is a tray to store paper sheets (recording media) to be used for image forming, and is installed on a lower side of the optical scanner 88 of the image forming section 82. The paper sheet(s) to be used for image forming can also be placed on a manual paper feed cassette 78. Also, the paper output tray 80 installed above the image forming section 82 is a tray on which the sheets having undergone image forming are outputted face down.

Further, installed in the image forming section 82 is a paper sheet conveying path 77 of a generally vertical shape for conveying the paper sheet on the paper feed cassette 71 or the manual paper feed cassette 78, by way of the transfer roller 87 and the fuser unit 74, to the paper output tray 80. In close proximity to the paper sheet conveying path 77 extending from the paper feed cassette 71 or the manual paper feed cassette 78 to the paper output tray 80 are disposed pickup rollers 73, 75, a plurality of conveyance rollers 62, 64, 66, 68, a paper stop roller 79, a transfer roller 87, a fuser unit 74 and so forth.

The conveyance rollers 62, 64, 66, 68 are small rollers to facilitate and assist conveyance of the paper sheet, and the plurality of them are installed along the paper sheet conveying path 77. Also, the pickup roller 73 is installed in close proximity to an edge of the paper feed cassette 71, picks up the paper sheets from the paper feed cassette 71 piece by piece, and supplies it to the paper sheet conveying path 77. Similarly, the pickup roller 75 is installed in close proximity to an edge of the manual paper feed cassette 78, picks up the sheets from the manual paper feed cassette 78 piece by piece, and supplies it to the paper sheet conveying path 77.

And then, the paper stop roller 79 is one that holds for a moment the paper sheet being conveyed on the paper sheet conveying path 77, and has a function to convey the paper sheet to the transfer roller 87 with a timing that adjusts the head of the paper sheet to the head of the toner image on the photoreceptor drum 90.

The fuser unit 74 includes a heating roller 72 and a pressure roller 76; and the heating roller 72 and the pressure roller 76 are configured so as to rotate holding the paper sheet between them. Also, the heating roller 72 is set to a predetermined fusing temperature by a control section based on the signal from a temperature sensor which is not illustrated, and performs, in cooperation with the pressure roller 76, a function of heat fusing on the paper sheet by means of the thermo-compression bonding of the toner to the paper sheet through fusing, mixing and pressure-contacting the multicolored toner image that has been transferred onto the paper sheet. An external heating belt 70 is also provided for heating the heating roller 72 from outside.

Next, paths through which the paper sheet is conveyed are explained in detail. As described above, the image forming apparatus is equipped with the paper feed cassette 71 for receiving the paper sheets beforehand and the manual paper feed cassette 78. In order to feed the paper sheets from these paper feed cassettes 71, 78, and then to lead the paper sheets piece by piece to the paper conveying path 77, the pickup rollers 73, 75 are respectively disposed.

The paper sheet conveyed from either of the paper feed cassettes 71, 78 is conveyed to the paper stop roller 79 by the conveyance roller 62 of the paper sheet conveying path 77, and then conveyed to the transfer roller 87 with a timing that adjusts the head of the paper sheet to the head of the image information on the intermediate transfer belt 94, whereby the image information is written onto the paper sheet. Subsequently, unfixed toner on the paper sheet is melted and stuck thereon by heat while the paper sheet passes through the fuser unit 74; and then through the conveyance roller 68 disposed downstream therefrom, the paper sheet is outputted onto the paper output tray 80.

The above-mentioned sheet conveying path is the one for use in the case of demand for single sided printing onto paper sheet; whereas in the case of demand for duplex printing, at the time when the paper sheet that has undergone the single sided printing and that has passed through the fuser unit 74 as described above is held at its rear edge by the final conveyance roller 68, the rotational direction of the conveyance roller 68 is reversed; whereby the paper sheet is led to the conveyance rollers 66, 64. Then, after passing through the paper stop roller 79 and undergoing printing on its rear face, the paper sheet is outputted onto the paper output tray 80.

Figure 2:
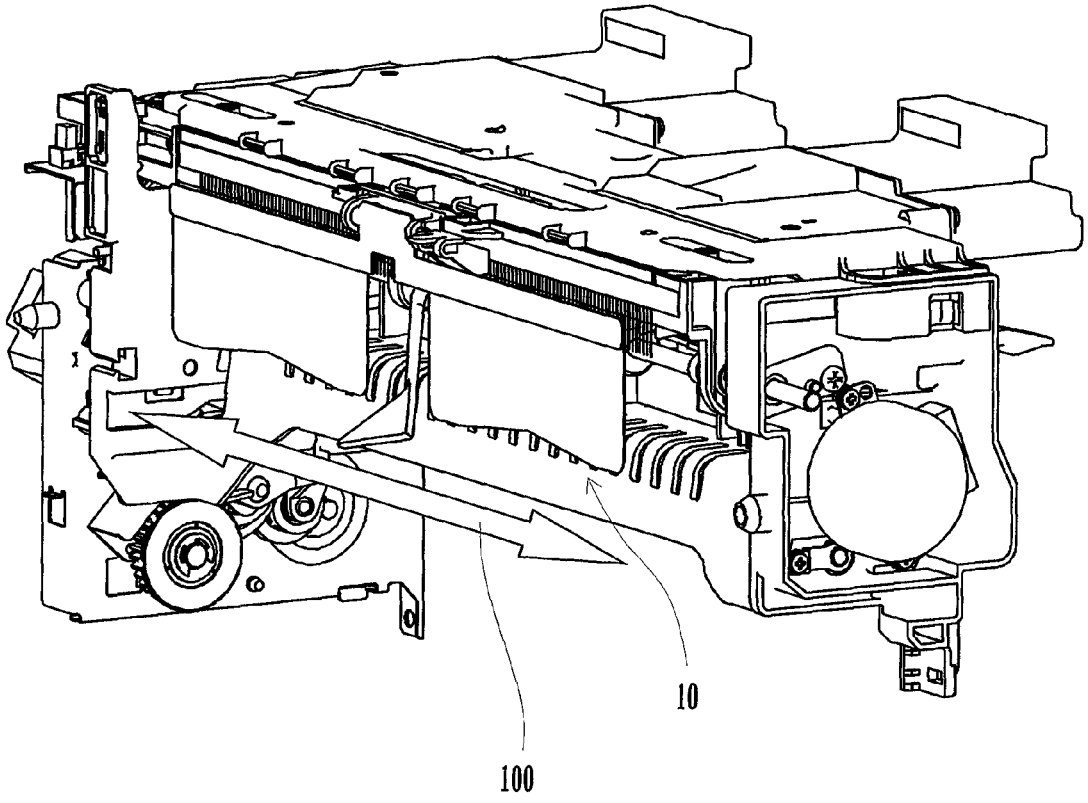
FIG. 2 is a drawing showing a configurative outline of a shifter.
Figure 3A:
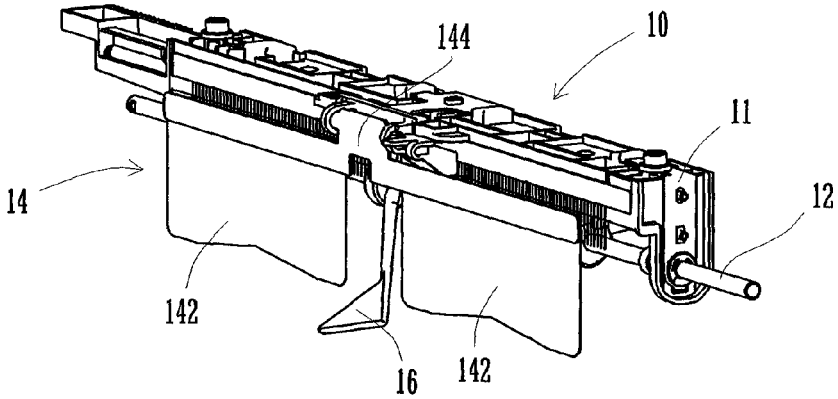
FIG. 3 is another drawing showing the configurative outline of the shifter.
Figure 3B:
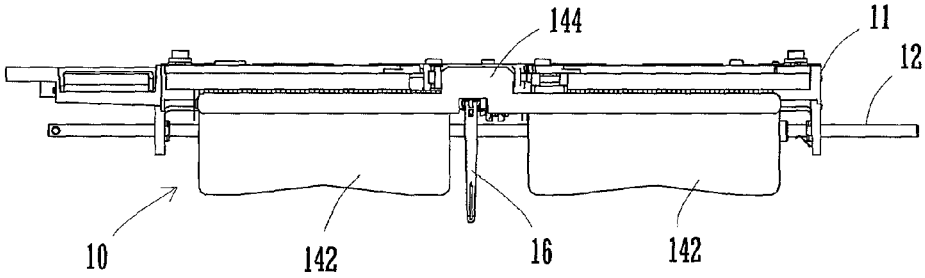
Figure 3C:
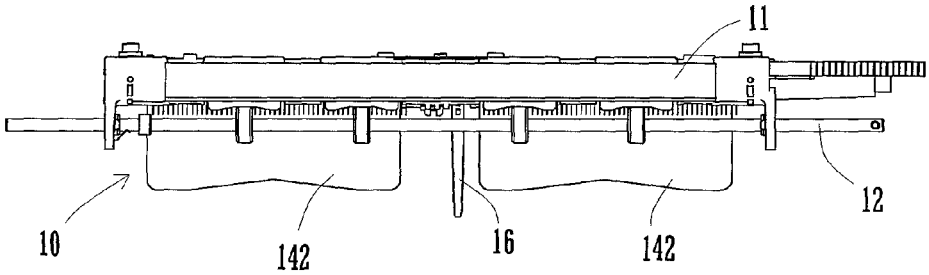
Figure 3D:
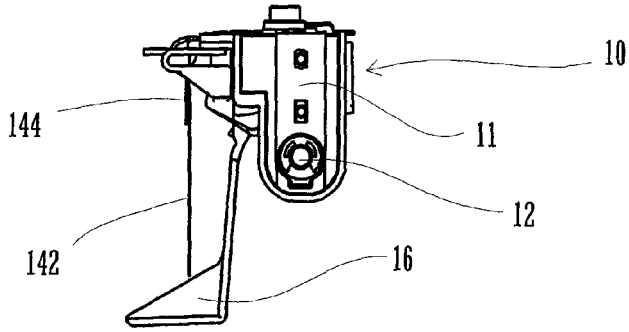

To a paper output port in the vicinity of the paper output tray 80 is installed a shifter 10. For example, at the time when the paper sheets are outputted successively onto the paper output tray 80, the shifter 10 causes the paper sheets to offset selectively. The shifter 10, as shown in FIG. 2, is supported by one of units constituting the image forming apparatus 50 in such a manner as to be capable of reciprocal movement in paper width direction (refer to an arrow 100 in FIG. 2) perpendicular to the paper sheet conveying direction.

Subsequently, using FIG. 3A through FIG. 3D, a configurative outline of the shifter 10 is explained. As shown in the figures above, the shifter 10 includes a main body 11 that is slidable on a movement shaft 12 disposed along the paper width direction. Supported by the main body 11 in such a manner as to be swingable are a paper hold-down member 14, and an actuator 16 of a fullness detection sensor to detect fullness of the paper sheets having been outputted on the paper output tray 80.

Figure 4A:
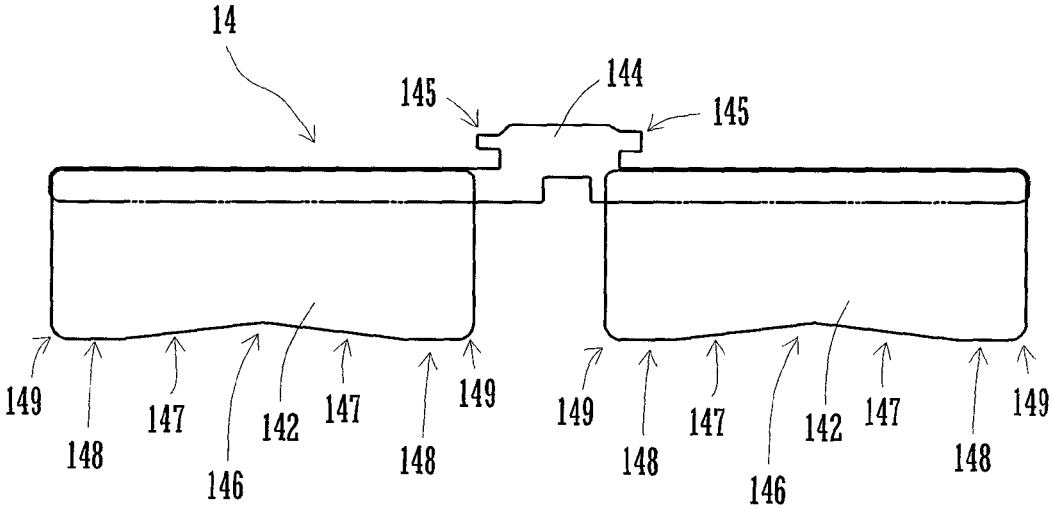
FIG. 4 is a drawing showing a configuration of a paper hold-down member.
Figure 4B:
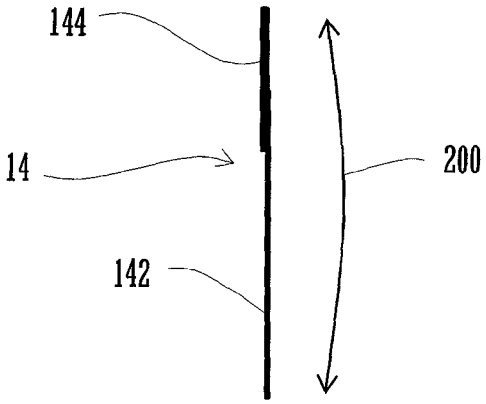

The paper hold-down member 14, as shown in FIG. 4A and FIG. 4B, includes a sheet supporting section 144 supported by the main body 11 through an engaging piece 145 in such a manner as to be swingable, and two paper hold-down sheets 142 stuck to the sheet support member 144.

The paper hold-down member 14 performs, through the paper hold-down sheets 142, a function to correct the curvature of a paper sheet in the paper width direction that is being outputted onto the paper output tray 80 by holding down, from top face side, both edge portions of the paper sheet in the paper width direction that is being outputted onto the paper output tray 80.

The paper hold-down sheets 142 are made of a material with flexibility, and are stuck on both right and left sides of the sheet supporting section 144 respectively using a double-sided adhesive tape. Further, in this embodiment, polycarbonate is employed as a material for the sheet supporting section 144, while PET is employed as the material for the paper hold-down sheets 142. However, materials for the sheet supporting section 144 and the paper hold-down sheet 142 or method of sticking the paper hold-down sheet 142 onto the sheet supporting section 144 is not limited to those described above.

The paper hold-down sheets 142 is configured, as shown in FIG. 4B, in such a manner as to be slightly curved so that it becomes convex toward a side where the paper sheet is brought into contact with it (refer to an arrow 200 in the drawing). However, because the above described curvature of the paper hold-down sheet 142 is not an essential requirement, paper hold-down sheets 142 without curvature and with flat shape may be used.

By means of a downward force applied to the paper sheet being outputted onto the paper output tray 80 by the paper hold-down sheets 142 through their contact, curvature of a paper sheet formed on both sides thereof in the paper width direction is corrected. To be concrete, when a rear edge of the paper sheet is disengaged from the conveyance roller 68, the paper sheet drops downward while being held down by the paper hold-down sheets 142.

Figure 5:
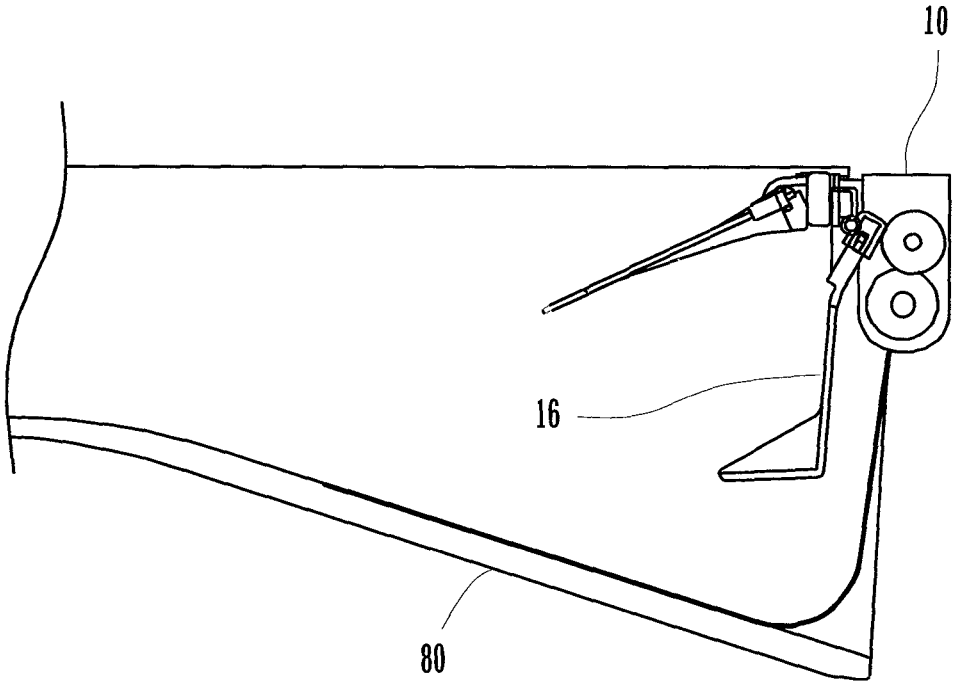
FIG. 5 is a drawing explaining a problem with a conventional paper hold-down member.

Here, with a conventional paper hold-down sheet, occurrences of failure to output a paper sheet have been experienced due to friction between the paper hold-down sheet 142 and the paper sheet. For instance, as shown in FIG. 5, it has been experienced that the paper sheet is pulled back toward a paper output port side because of the friction between the paper hold-down sheet 142 and the paper sheet, and consequently that paper jam occurs at the paper output port.

Thus, in this embodiment, a depressed portion 146 is provided in the middle of each paper hold-down sheet 142 so that a contact area between the paper hold-down sheet 142 and the paper sheet is decreased, whereby the friction between the paper hold-down sheet 142 and the paper sheet is prevented from developing excessively. The depressed portion 146 has an inclined edge portion 147 that is inclined in such a manner that the inclined edge portion gets further away from the paper sheet as it gets closer to the middle of the depressed portion 146. The inclined edge portion 147 is configured in such a manner as to be symmetrical with reference to the middle of the paper hold-down sheet 142.

Further, the depressed portion 146 is configured in such a manner that the inclined edge portion 147 has a moderate inclination so that an amount of cut-off forming the depressed portion 146 does not become more than is required. The reason is that a weight of the paper hold-down sheet 142 decreases as the amount of cut-off forming the depressed portion 146 increases, which results in a reduction of force to hold down the edge portions of the paper sheet in the paper width direction, and consequently that there arises a risk that capability to suppress the curling deteriorates. It is also the reason that an inclination angle of the inclined edge portion 147 becomes large when the inclination of the inclined edge portion 147 is large, whereby a risk arises that the paper sheet being in contact with the inclined edge portion 147 gets caught when the shifter 10 moves. Practically, the inclination angle of the inclined edge portion 147 is preferably set to around 3-10 degrees, and more preferably to around 5-7 degrees.

Being provided with the depressed portion 146 in a manner as stated above, each paper hold-down sheet 142 results in taking a shape with the symmetrical inclined edge portion 147 disposed in the middle and linear straight edge portions 148 disposed on both sides of it. Also, a distance between the straight edge portion 148 of the paper hold-down sheet 142 on the right side and the straight edge portion 148 of the paper hold-down sheet 142 on the left side is configured in such a manner as to be smaller than a width of a minimum size paper sheet (example: postcard) that can be printed with the image forming apparatus 50. The reason for doing so is to prevent a small sized paper sheet from being caught between the straight edge portion 148 of the paper hold-down sheet 142 on the right side and the straight edge portion 148 of the paper hold-down sheet 142 on the left side when the shifter 10 moves.

And when a plurality (two pieces in this embodiment) of the paper hold-down sheets 142 are attached to the sheet supporting section 144, an outer edge portion at portions of which the plurality of the paper hold-down sheets 142 are to be in contact with the paper sheet gets to take an undulated shape. Further, each paper hold-down sheet 142 is provided with an arc (curved with a radius) portion 149 on the outside of each straight edge portion 148. With the arc portion 149 formed, it becomes less likely that the paper hold-down sheet 142 catches the paper sheet when the shifter 10 moves.

Figure 6A:
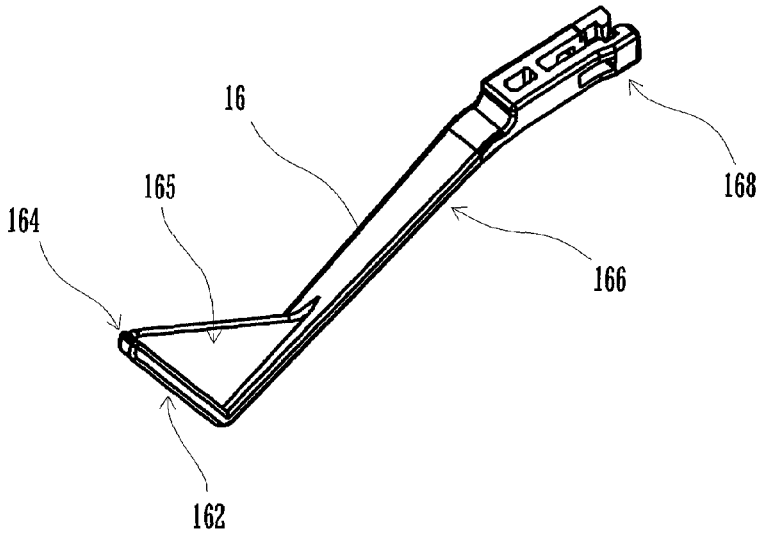
FIG. 6 is a drawing showing a configuration of an actuator.
Figure 6B:
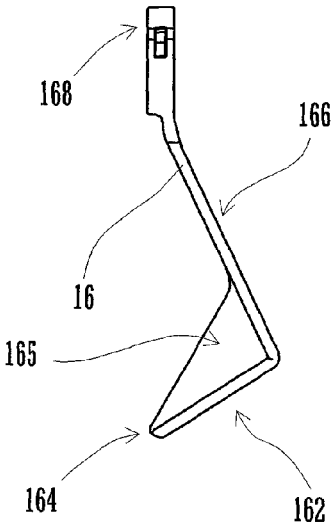
Figure 6C:
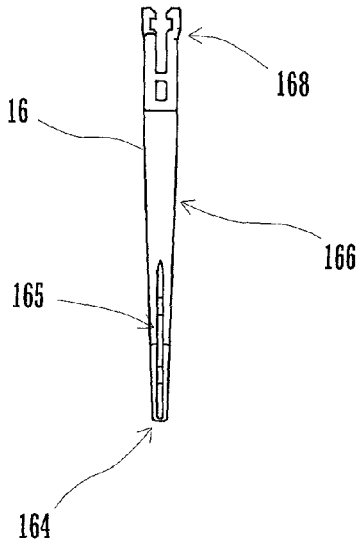

Subsequently, using FIG. 6A through FIG. 6C, a configurative outline of the actuator 16 is explained. The actuator 16 is supported by the main body 11 of the shifter 10 through a support portion 168 provided at one end of an arm section 16 so as to be swingable. Attached to the other end side of the arm section 16 is a triangular plate-like member 165, and a neighboring area of a vertex of the plate-like member 165 constitutes a fullness detection section 164 that is to be in contact with an uppermost paper sheet on the paper output tray 80. Also, a curling paper detection section 162 is provided along one side of the plate-like member 165. Further, as shown in FIG. 6C, the actuator 16 has a shape such that it tapers off in a direction from the support portion 168 toward the fullness detection section 164. The reason for employing such a shape is to prevent the actuator 16 from getting heavier than a conventional one due to the additionally disposed plate-like member 165 forming the curling paper detection section 162.

Figure 7A:
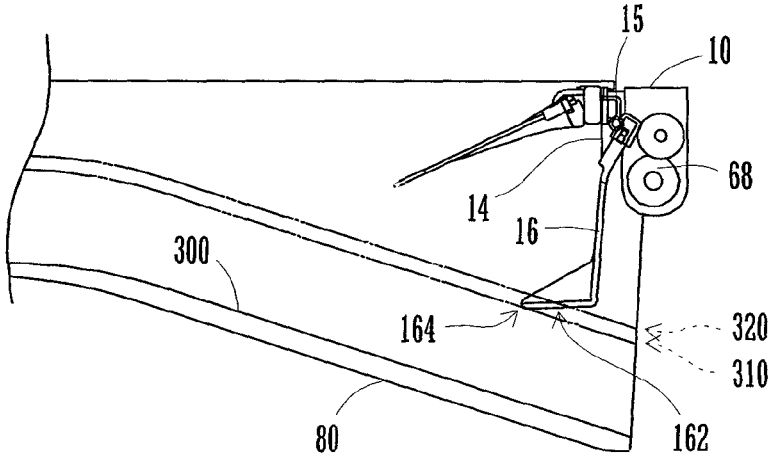
FIG. 7 is a drawing explaining a relationship between states of outputted paper and the actuator.
Figure 7B:
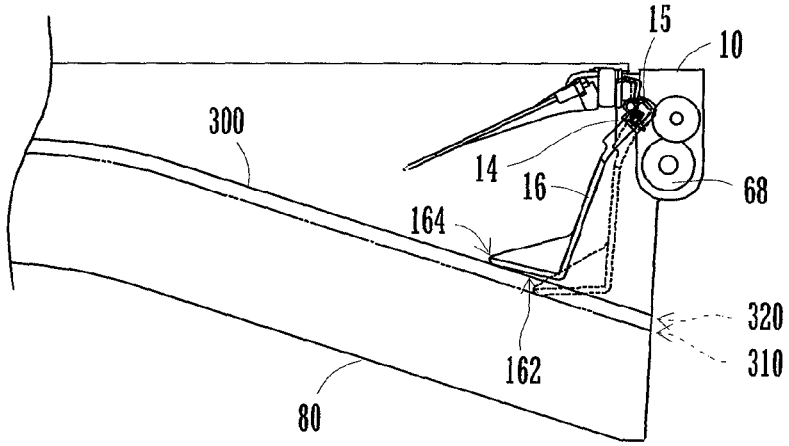
Figure 7C:
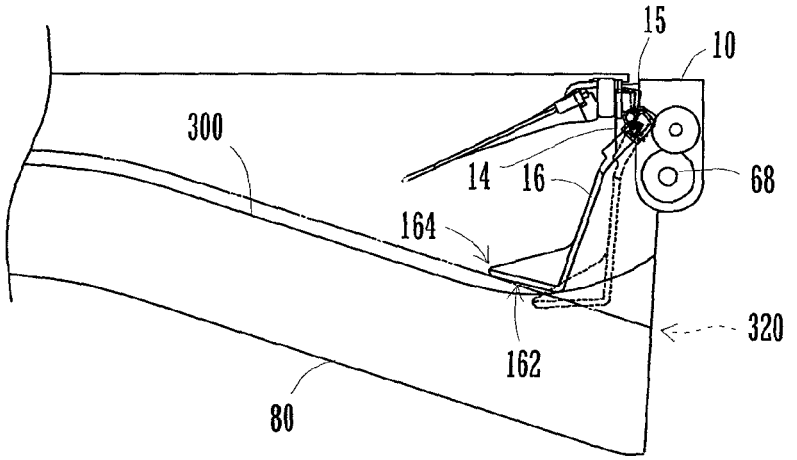

Next, using FIG. 7A through FIG. 7C, operation of the actuator 16 is explained briefly. In FIG. 7A through FIG. 7C, the imaginary line 310 shows a position of the fullness detection section 164 of the actuator 16 disposed at its standby position, whereas the imaginary line 320 shows a position of the fullness detection section 164 of the actuator 16 disposed at its fullness detecting position.

As shown in FIG. 7A, when the uppermost paper sheet 300 having been outputted on the paper output tray 80 is located below a position shown by the imaginary line 310, although the actuator 16 is once lifted by the paper sheet while the paper sheet is outputted, thereafter it returns to the standby position.

Then, at the moment when the uppermost paper sheet 300 having been outputted on the paper output tray 80 reaches a position shown by the imaginary line 310, the actuator 16 gets being lifted by the uppermost paper sheet 300. At this stage, the more the number of the paper sheets on the paper output tray 80 is increased, the more the actuator is displaced toward the upper direction. Then, as shown in FIG. 7B, when the uppermost paper sheet 300 reaches a position shown by the imaginary line 320, the actuator 16 arrives at the fullness detecting position. The position of the actuator 16 is detected by a photo sensor 15. When the actuator 16 arrives at the fullness detecting position, the photo sensor 15, being shaded the light thereof by a shading section, is caused to output a signal. When the actuator 16 keeps on staying at the fullness detecting position not less than a predetermined time, that is to say when the signal is kept being output from the photo sensor 15, the control section of the image forming apparatus 50 detects that the paper sheets on the paper output tray 80 have reached a state of fullness. Then, a user is notified of the detected result through a display.

Further, as shown in FIG. 7C, with the curling paper detection section 162 provided, when a rear edge of a paper sheet has a curl toward the upper direction and even when the uppermost paper sheet does not reach the position shown by the imaginary line 320, the actuator 16 is lifted up to the fullness detecting position. As a result, such a malfunction as a rear edge of a paper sheet is jammed between the rollers (here, the conveyance roller 68) disposed at a paper output port when the paper sheet having been outputted on the paper output tray 80 has a curled rear edge is prevented from occurring.

The curling paper detection section 162 is formed so as to be inclined in relation to the paper paper loading surface in such a manner as to get further away from the paper paper loading surface of the paper output tray 80 when viewed toward a direction opposite to a paper conveying direction. As an inclination angle of the curling paper detection section 162 gets closer to the one parallel to the paper paper loading surface of the paper output tray 80, the actuator 16 gets being lifted by a smaller amount of curling through the curling paper detection section 162. Accordingly, it is recommended that the inclination angle of the curling paper detection section 162 in relation to the paper paper loading surface be set depending on the extent to which the amount of curling is permitted.

For example, in this embodiment, in a case where a paper sheet having a curled rear edge has been outputted on the paper output tray 80, the shape of the curling paper detection section 162 and the arrangement of the actuator 16 are designed so as to make a fullness detection at a nearly 100 pieces (paper sheets) earlier stage as compared with a case where a conventional actuator is used. Practically, the curling paper detection section 162 is preferably inclined by around 1 to 15 degrees in relation to the paper paper loading surface of the paper output tray 80.

Additionally, since the actuator 16 is supported by the main body 11 of the shifter 10 in such a manner as to be swingable, the curling paper detection section 162 approaches a posture thereof parallel to the paper loading surface of the paper output tray 80 as the number of outputted paper sheets nears the state of fullness. Therefore, the tolerance limit for curling decreases as the number of the outputted paper sheets increases, while the tolerance limit for curling is large when the number of the outputted paper sheets remains small. As a result, when the number of the outputted paper sheets is near the fullness, detection of fullness is prone to occur by a rear edge of a paper sheet curling just a little upward.

With the above-mentioned embodiment, such a malfunction as a paper sheet having a curled rear edge and having been outputted on the paper output tray 80 is jammed between the output rollers is prevented from occurring. Also, failure to perform the paper output conveyance of a paper sheet being outputted that results from the friction between the paper hold-down sheet 142 and the paper sheet is prevented from occurring. Moreover, the use of only a single actuator 16 makes it possible to simply detect both a state of fullness and a state of curling of the paper on the paper output tray 80. In particular, because replacing the conventional actuator with the actuator 16 makes it possible to detect both the state of fullness and the state of curling of the paper on the paper output tray 80, any structures to be added newly can be minimized.

The above explanation of the embodiment is nothing more than illustrative in any respect, nor should be thought of as restrictive. Scope of the present invention is indicated by claims rather than the above embodiment. Further, it is intended that all changes that are equivalent to a claim in the sense and realm of the doctrine of equivalence be included within the scope of the present invention.

REFERENCE SIGNS LIST

10 shifter
11 main body
12 shaft
14 paper hold-down member
16 actuator
50 image forming apparatus
162 curling detection section
164 fullness detection section
166 arm section
168 support portion

The invention claimed is:

1. A paper output device comprising:

a paper output tray configured in such a manner that a sheet of paper having undergone a predetermined process is outputted thereon;

an actuator supported in such a manner as to be swingable above a paper loading surface of the paper output tray, the actuator being configured in such a manner as to be displaced upward by a force acting thereon from an uppermost sheet of paper as a position of the uppermost sheet of paper on the paper output tray rises; and a fullness determination section that determines that the sheets of paper on the paper loading surface of the paper output tray have reached a state of fullness upon detecting that the actuator has been displaced to a predetermined height by the uppermost sheet of paper on the paper output tray, wherein the actuator at least includes:

a fullness detection section disposed at a tip portion thereof and configured so as to be in contact with the uppermost sheet of paper on the paper output tray; and a rear edge curling detection section formed so as to extend from the fullness detection section toward a direction that gets further away from the paper loading surface of the paper output tray when viewed toward a direction that is generally parallel to the paper loading surface of the paper output tray and is opposite to a paper conveying direction.

2. The paper output device as claimed in claim 1, wherein the actuator is configured in such a manner that the rear edge curling detection section approaches a posture thereof parallel to the paper loading surface of the paper output tray as the sheets of paper on the paper output tray get closer to the state of fullness.

3. The paper output device as claimed in claim 2, wherein the actuator is supported in such a manner as to be swingable by a shifter capable of reciprocal movement in width direction perpendicular to the paper conveying direction.

4. The paper output device as claimed in claim 3, wherein the actuator is configured in such a manner as to taper off toward the fullness detection section.

5. The paper output device as claimed in claim 4 further comprising a paper hold-down member configured so as to hold down downward both edge portions in the width direction, which is perpendicular to the paper conveying direction, of a sheet of paper being outputted onto the paper output tray.

6. An image forming apparatus comprising the paper output device as claimed in claim 1.

7. An image forming apparatus comprising the paper output device as claimed in claim 2.

8. An image forming apparatus comprising the paper output device as claimed in claim 3.

9. An image forming apparatus comprising the paper output device as claimed in claim 4.

10. An image forming apparatus comprising the paper output device as claimed in claim 5.

* * * * *